US008409301B1

(12) United States Patent
Ackerman

(10) Patent No.: US 8,409,301 B1
(45) Date of Patent: Apr. 2, 2013

(54) TOSS-DYE RANDOM CLOTHING DESIGN SYSTEM AND METHOD

(76) Inventor: Jake Ackerman, South Jordan, UT (US)

( * ) Notice: Subject to any disclaimer, the term of this patent is extended or adjusted under 35 U.S.C. 154(b) by 0 days.

(21) Appl. No.: 13/552,051

(22) Filed: Jul. 18, 2012

(51) Int. Cl.
*D06B 11/00* (2006.01)

(52) U.S. Cl. ..... 8/483; 8/478; 8/479

(58) Field of Classification Search ..... 8/479
See application file for complete search history.

(56) References Cited

U.S. PATENT DOCUMENTS 2,199,093 A 12/1937 Wolfenden
5,288,322 A * 2/1994 Hanna et al. ..... 118/33

OTHER PUBLICATIONS

"Color Me Rad 5K Comes to Hartford—May 26" written by Karen Stephens, published in the Connecticut Weekender on May 8, 2012, accessed online at http://ctweekender.com/2012/05/color-me-rad-5k-comes-to-hartford-may-26/ pp. 3-5.*
"How to Dye Fabric with Natural Dyes" published on Earth Divas' Blog on Jul. 13, 2010, acccessed online at http://earthdivasblog.com/2010/07/13/how-to-dye-fabric-with-natural-dyes/, pp. 1-5.*
Karkabi, Barbara The Houston Chronicle, Mar. 7, 2009, Religion Section; p. 2, "Festival of Colors" (relevance, paragraph 4).
Kelso, John The Gazette (Montreal, Quebec), Nov. 1, 2001 (relevance full text paragraph 12).

* cited by examiner

*Primary Examiner* — Harold Y. Pyon
*Assistant Examiner* — Katie L Hammer
(74) *Attorney, Agent, or Firm* — Lyman Moulton, Esq.

(57) ABSTRACT

As disclosed, a toss-dye random clothing design system and method comprises at least one article of clothing worn by a runner at a race, a sporting event, a corporate or collegiate event, a fashion party, a production plant shift and the like, a plurality of colored dyes provided at a plurality of throwing stations, at least one thrower positioned at a throwing station to throw the dyes onto the clothing as the runner passes by the throwing station, and a random pattern of throw-dye on the clothing based on a confluence of the thrown colored dyes and a path the runner takes there through. Embodiments of the disclosure may include a throw-dye configured to stick to the clothing article(s) in places where moisture is present and a template configured to block the thrown dyes from making contact with the clothing and thereby outline a corporate or collegiate logo thereon.

12 Claims, 6 Drawing Sheets

TOSS-DYE RANDOM CLOTHING DESIGN SYSTEM AND METHOD

BACKGROUND AND FIELD OF INVENTION

Clothing may remind the wearer of a particular event they experienced while wearing the clothing article. For instance, a t-shirt signing or concert and sporting event paraphernalia can help the wearer relive a particular event or show to others that they were in attendance. Tourists also like to buy clothing from a port of call or a foreign destination to say to others something about where they have been or what they did there. However, such mass produced clothing is generic to the port of call or the mass event.

Also, not everyone wants to wear clothing purchased from department store shelves and racks all the time. Some prefer to wear something original that gets attention and projects 'who they are' to others. Prices for haute couture fashion and designer custom clothing have traditionally been too high for regular consumption by the general public. Even less sophisticated and much less expensive sources of clothing design are not regularly available to most consumers outside of infrequent shopping trips overseas where the American dollar has traditionally afforded a bargain.

For those wanting custom designed clothing but unable to afford a designer the fashion industry is continually seeking new looks and a successor to the tie-dye designs of the late 1960s and early 1970s. Some designs for mass consumption have included pseudo-random pattern designs generated by methodical methods and programmable machines. However, such clothing does not tell a story of an experience nor convey a unique image of the wearer. For these reasons and more, there has been a long felt need for consumers to be able to buy custom clothing that projects a particular image to others and/or reminds the wearer of a particular place or event.

SUMMARY OF THE INVENTION

A method of design for an article of clothing comprises wearing at least one article of clothing on at least one runner and providing at least one colored dye at least one throwing station. The disclosed method may also comprise throwing the at least one colored dye onto the article(s) of clothing via at least one human thrower positioned at the throwing station(s) as the runner passes by the throwing station. The disclosed method may further comprise dyeing the article(s) of clothing in a random pattern based on a confluence of the thrown to colored dyes and a path of the runner there through.

A system of design for an article of clothing is also disclosed. The method comprises at least one article of clothing worn on at least one runner of a multi-runner event and a plurality of colored dyes (powdered or liquid) provided at a plurality of throwing or tossing stations. The system may also include at least one thrower or 'tosser' positioned at a throwing or tossing station placed along at least one route of the event. The throwing station may be provided for throwing or tossing at least one of the dyes onto the article(s) of clothing as the runner passes by the station. The system may further include a random pattern of throw-dye on the article(s) of clothing based on a confluence of the thrown colored dyes and a path of the runner there through.

Other aspects and advantages of embodiments of the disclosure will become apparent from the following detailed description, taken in conjunction with the accompanying drawings, illustrated by way of example of the principles of the disclosure.

Figure 1:
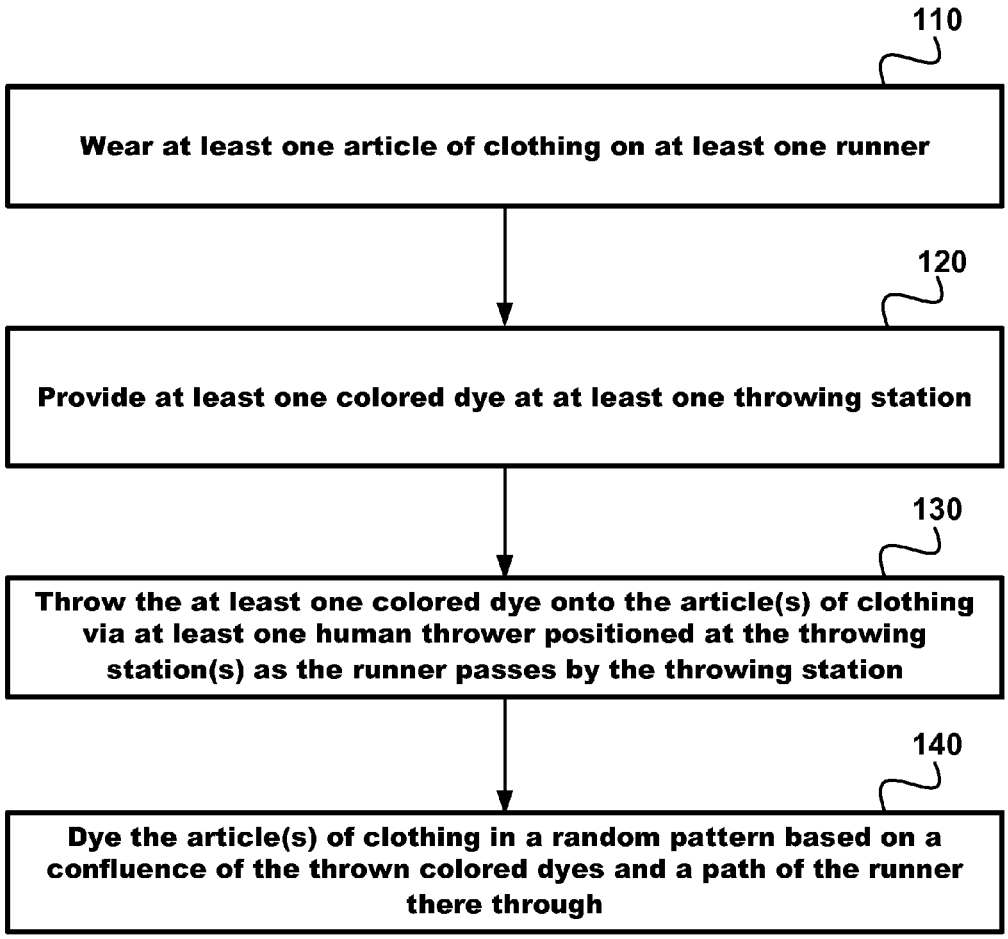
FIG. 1 is a flow chart of a method for throw-dye random clothing design in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The terms 'throw' and 'toss' may be used interchangeably throughout the present disclosure. Therefore, respective gerunds 'throwing' and tossing' and words such as 'thrower' or 'tosser' may also be used interchangeably in the disclosure, including the specification and the claims. Synonyms of toss and throw may also be interchangeably used in the disclosure including but not limited to fling, hurl, pitch, dash, sling, cast, etc. Additionally, the term 'dye' may refer to a powdered dye, a liquid dye and a gel dye and any composition thereof which stains or colors and otherwise permanently changes the appearance of clothing or articles worn on the body. Therefore, the term 'dye' may also include 'sparkle' particles and particulates which reflect or give off light of various frequencies. The term 'dye' may also include mud slung onto a runner and his or her clothing, the mud composing dirt and water or dirt and any other liquid catalysts and natural hues, tones and colors. Furthermore, the term 'runner' used in the present disclosure may include a person or persons walking, running, jogging, skipping, galloping, crawling and otherwise moving over ground by any natural or mechanical means. The term 'runner' may also refer to a person or persons participating in a sporting event including competitive and non-competitive activities. The term 'path' used throughout the present disclosure is defined by a common dictionary definition comprising a trodden way, course or route. Therefore, a path of the runner refers to the way, course or route a runner takes. The term or word 'confluence' used throughout the present disclosure is defined by a common dictionary definition comprising coming flowing or running together and therefore refers to the runner and a thrown dye corning, flowing or running together. Also, the term or word 'parallel' used herein is defined by a common dictionary definition comprising extending in the same direction, everywhere equidistant and not meeting. Therefore, with respect to a race route or a 'path' of the runner as described and claimed herein, a parallel throwing station is equidistant with the runner's path and extends in the same direction therewith. The term or word 'trigger' is also defined by a common dictionary definition including to initiate, actuate or to set off a process and therefore refers to actuating or starting a thrower dispersal mechanism as further disclosed herein. The term or word 'sensor' is defined by a common dictionary definition to include a device that responds to a physical stimulus (as heat, light, sound, motion, etc) and transmits a resulting impulse. Thusly a sensor in the present disclosure refers to a device which responds to a runner's adjacency to a throwing station through heat, light, sound and/or motion and transmits an impulse to actuate or set off a thrower dispersal mechanism as claimed herein.

FIG. 1 is a flow chart of a method for throw-dye random clothing design in accordance with an embodiment of the present disclosure. A method of design for an article of clothing comprises wearing 110 at least one article of clothing on at least one runner and providing 120 at least one colored dye at at least one throwing station. The disclosed method may also comprise throwing 130 the at least one colored dye onto the article(s) of clothing via at least one human thrower positioned at the throwing station(s) as the runner passes by the throwing station. The disclosed method may further comprise dyeing 140 the article(s) of clothing in a random pattern based on a confluence of the thrown colored dyes and a path of the runner there through. A thrower or a runner may comprise a celebrity, a well-known personality, a recognized fashion designer, a certified fashion designer and the like including designers of haute couture design, ready-to-wear design and any design of an article of dress including all clothing and fashion accessories. A thrower may also comprise a plurality of attendees to at least one of a race, a sporting event, a corporate event, a scholastic event, a fashion party, a production plant shift and the like conducted in one of an organized manner and in a random manner.

Figure 2:
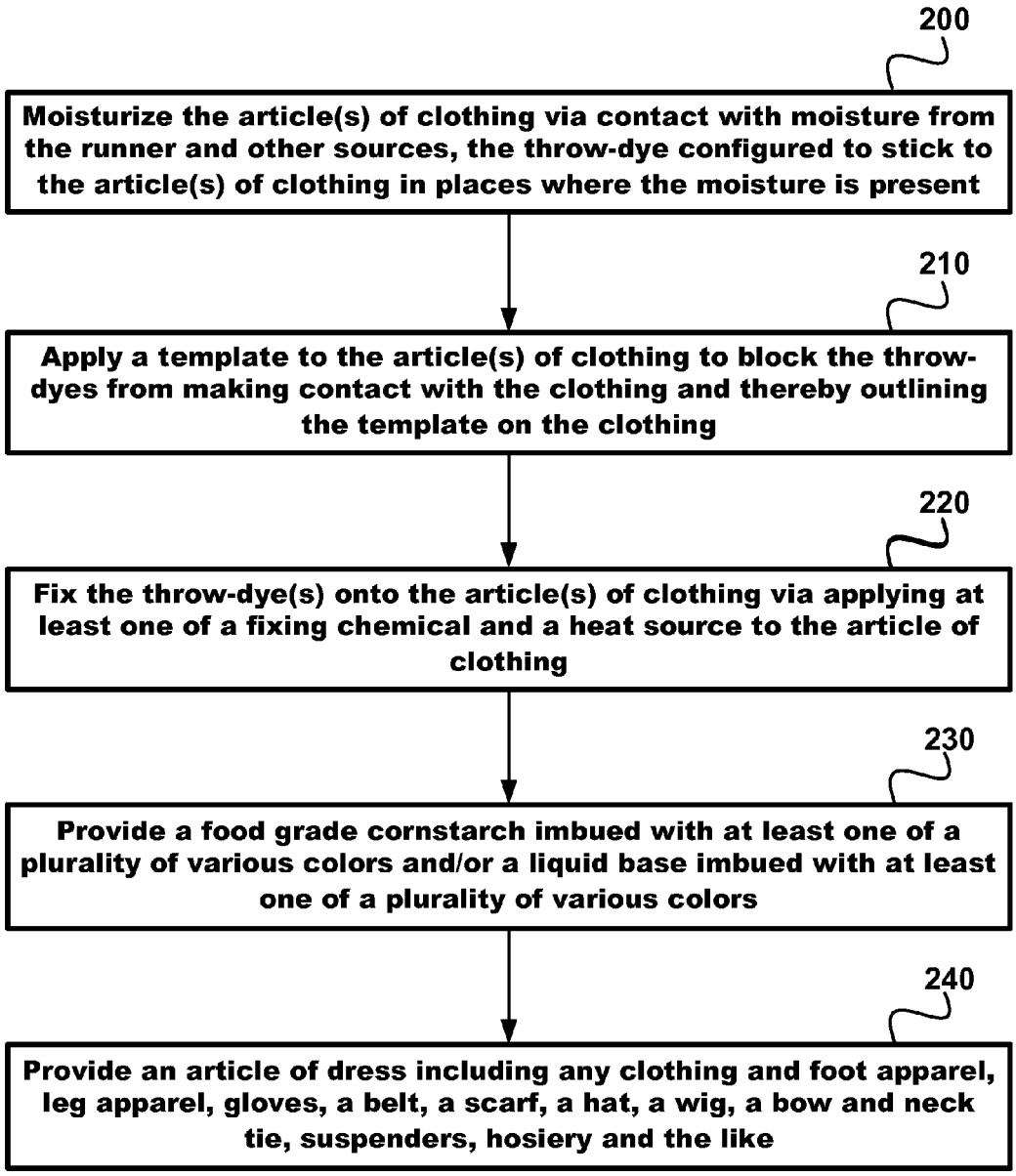
FIG. 2 is a flow chart of embodiments of a method for throw-dye random clothing design in accordance with an embodiment of the present disclosure.

FIG. 2 is a flow chart of embodiments of a method for throw-dye random clothing design in accordance with an embodiment of the present disclosure. An embodiment of the disclosed method for the random design of an article of clothing may further comprise moisturizing 200 at least one portion of the article(s) of clothing via contact with moisture from one of the runner and a source of moisture external to the runner including spraying the runner as she or he runs past a throwing station, the throw-dye configured to stick to the article(s) of clothing in places where the moisture is present. Moisture from the runner may include the runner's sweat and water the runner may be carrying. Moisture external to the runner may be spot sprayed onto the runner or the runner may be totally immersed in the moisture. Moisture external to the runner may include water and water based solutions. The moisture may provide a catalyst for activating the dye where the dye may be in powder or liquid form. Therefore, dye which makes contact with the moisture catalyst my dye and stain the clothing but dye which does not make contact with the moisture catalyst may not dye or stain the clothing and may be subsequently washed out of the clothing.

An embodiment may also comprise applying 210 a template to the article(s) of clothing, the template configured to block the throw-dyes from making contact with the article(s) of clothing and thereby outlining the template on the article(s) of clothing with the throw-dyes. Additionally, an embodiment may comprise fixing 220 or setting the throw-dye(s) onto the article(s) of clothing via applying at least one of a fixing chemical and a heat source to the article of clothing. A further embodiment may comprise providing 230 at least one colored throw-dye(s) including a food grade powdered cornstarch imbued with at least one of a plurality of various colors and/or providing at least one colored throw-dye(s) comprises a liquid base imbued with at least one of a plurality of various colors.

Various other embodiments may include providing an article of dress including any clothing and clothing ensemble worn on the client's body and any clothing and clothing ensemble worn over clothing on the client's body. Therefore tee shirts, shorts, exercise and work-out sweats and the like are comprised in the disclosed article(s) of clothing. The clothing worn by a runner may be substantially white and configured to contrast with the colored dyes sticking to the clothing. Substantially white clothing may include prints and patterns on a white or mostly white background and shades of white. The embodiments thus may also include providing 240 an article of dress and/or an accessory comprising any fashion accessory including foot apparel and leg apparel, gloves, a belt, a scarf, a hat, a wig, a bow and neck tie, suspenders, hosiery and the like.

Figure 3:
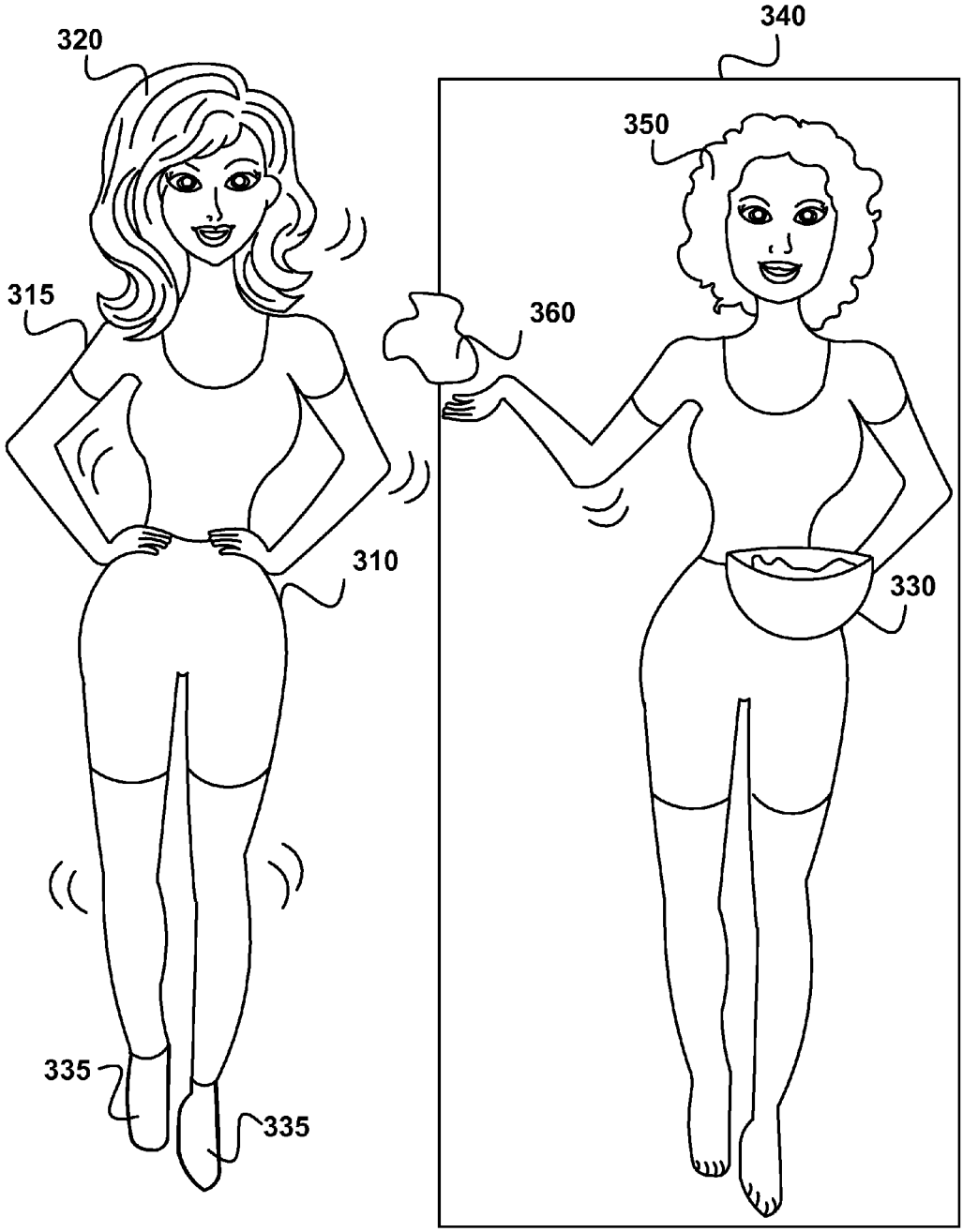
FIG. 3 is a depiction of a system for throw-dye random clothing design including a runner and a thrower in accordance with an embodiment of the present disclosure.
Figure 4:
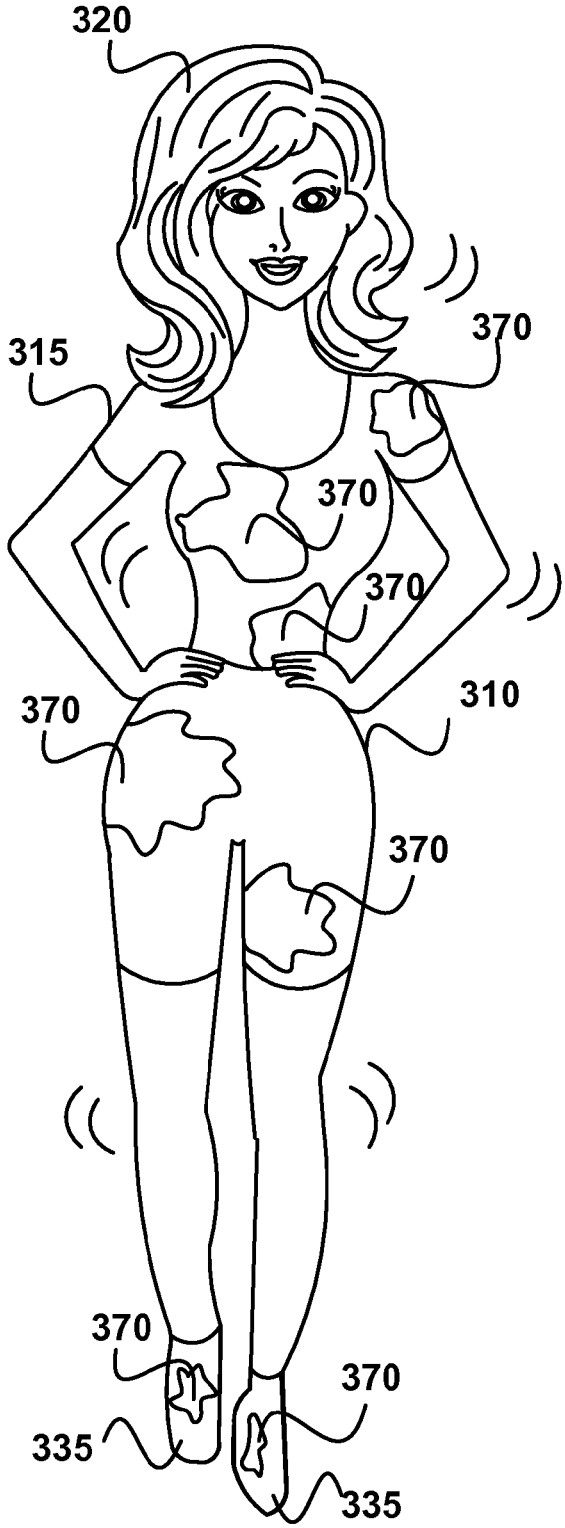
FIG. 4 is a depiction of a random pattern of throw-dye on a clothed runner based on a confluence of the thrown colored dyes and a path of the runner in accordance with an embodiment of the present disclosure.

FIG. 3 is a depiction of a system for throw-dye random clothing design including a runner and a thrower in accordance with an embodiment of the present disclosure. The system of design for an article of clothing may include at least one article of clothing 310 and another 315 worn on at least one runner 320 and at least one colored dye 330 provided at at least one throwing station 340. Accessories such as shoes, slippers, socks and the like depicted as 335, may also be worn and dyed through the disclosed system and method. The system may also include at least one thrower 350 positioned at the throwing station 340 for throwing the at least one colored dye 330 onto the article(s) of clothing 310 as the runner 320 passes by the throwing station 340. A confluence of the thrown colored dyes 360 and a path of the runner 320 through the thrown dye 360 may create a random colored pattern on the runner's clothing as depicted in FIG. 4 explained below. The dye 330 and 360 may be one of a soluble dye (temporary dye) and an insoluble dye (permanent and/or semi-permanent). The dye 330 and 360 may be one of a powder that is activated by contact with moisture as a catalyst on the runner's clothing and/or accessories or the dye 330 and 360 may be a liquid base dye. The insoluble dye may permanently change the appearance of the article of clothing upon contact with it and impregnating the runner's clothing and accessories or it may form a layer on the clothing and/or accessories. The throwing station 340 may be a designated area in a race route for a thrower to be stationed or it may be a structure with an automated throwing mechanism depending on the needs and character of the event. A thrower at a throwing station may therefore throw dye and/or throw moisture such as water, a dye catalyst and a liquid dye at the runner(s) as he or she passes the throwing station.

Where the throwing station is a designated area, the area may be designated by lines, markers, cones or any other visual indicia and may even simply be an area adjacent to the thrower or 'tosser.' Additionally, a throwing station may include a placement of a mechanized throwing or tossing device for getting dye into the path of a runner or participant in a sporting event.

FIG. 4 is a depiction of a random pattern of throw-dye on a clothed runner based on a confluence of the thrown colored dyes and a path of the runner in accordance with an embodiment of the present disclosure. A random pattern of moisture 370 on the articles of clothing 310 and 315 is depicted. After the dye is to thrown or tossed, a random pattern of the thrown-dye 370 may also be present on the article(s) of clothing 310 and 315 and accessories 335 based on a confluence of one or more thrown colored dyes 360 and a path of the runner 320 there through. In fact, the throw-dye 360 may be configured to stick to the article(s) of clothing in places (depicted by the thrown-dye 370) where moisture is present on the article(s), the moisture provided via one of sweat from the runner 320 and water and other fluids coming from sources external to the runner such as from the throwing station 340 or elsewhere including the weather. The moisture may affect only portions of the runner's clothing and/or totally immerse the runner. Moisture affecting only portions of the runner's clothing may effect a random dye pattern on the runner's clothing. The random patterns depicted in FIG. 4 are not meant to be limiting to the type or number of patterns that may be randomly disposed on the runner's clothing. Smaller and more numerous random patterns may also be included in the present disclosure.

Figure 5:
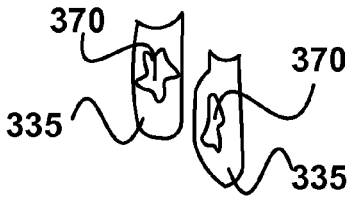
FIG. 5 is a depiction of a random pattern of throw-dye on a runner's clothing and accessories removed from the runner after a confluence of the thrown colored dyes and a path of the runner in accordance with an embodiment of the present disclosure.

FIG. 5 is a depiction of a random pattern of throw-dye on a runner's clothing and accessories removed from the runner after a confluence of the thrown colored dyes and a path of the runner in accordance with an embodiment of the present disclosure. The depiction includes the foot wear 335 with thrown-dye 370 fixed thereon in a random pattern. The depiction also includes the articles of clothing 310 and 315 also bearing a fixed pattern of thrown-dye fixed thereon. A fixing chemical and catalyst configured to fix the throw-dye(s) into the article(s) of clothing are also included in the embodiment. The fixing chemical(s) may include vinegar and any catalyst including heat applied to the article(s) of clothing to secure the dye in place. The article of clothing 310 may be shorts, gym or workout attire and even undergarments. The article of clothing 315 may include a blouse, a shirt, gym or workout attire and also an undergarment.

Figure 6:
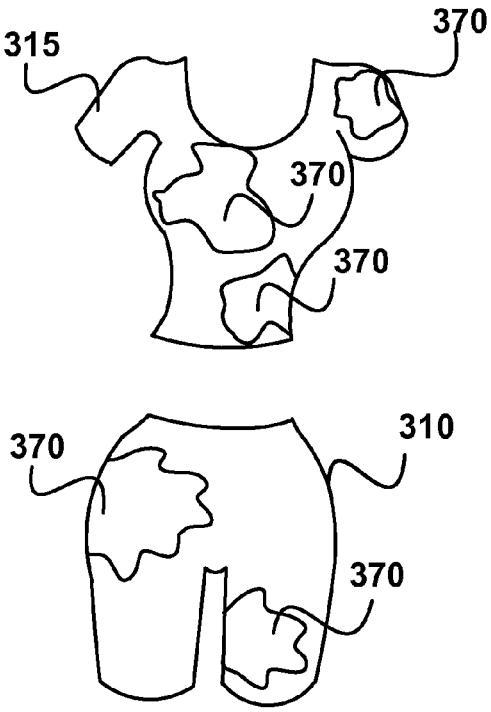
FIG. 6 is a depiction of logo template on an article of clothing, the template configured to block a throw-dye onto the clothing in accordance with an embodiment of the present disclosure.
Figure 6:
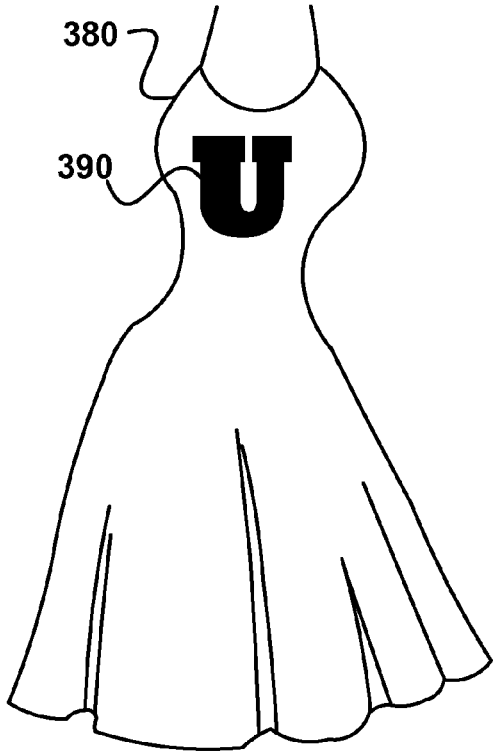

FIG. 6 is a depiction of logo template on an article of clothing, the template configured to block a throw-dye onto the clothing in accordance with an embodiment of the present disclosure. An embodiment of the system of design for an article of clothing 380 such as a dress, may further comprise a logo template 390 configured to apply to the dress 380 and block the throw-dyes 360 from making contact with the dress 380 and therefore outlining the logo 390 on the dress 380. Reverse templates may also be included in embodiments of the present to disclosure. A reverse template may protect the article of clothing everywhere except for an area where the runner or wearer of the clothing may want the throw-dye to adhere.

Figure 7:
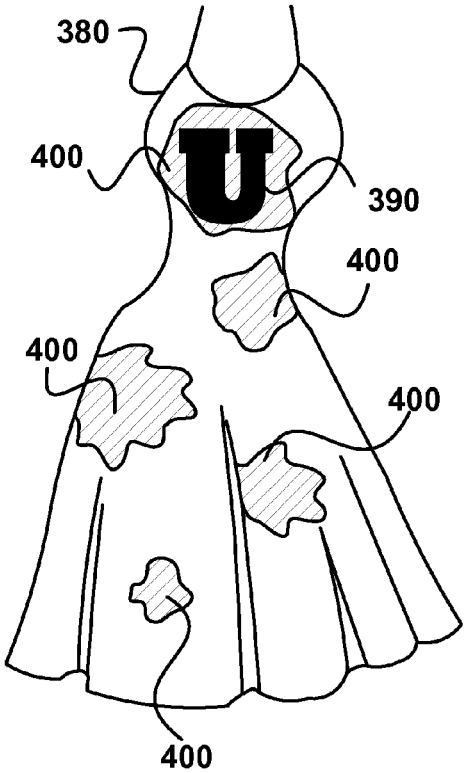
FIG. 7 depicts the article of clothing after throw-dyes have adhered to the dress but have been blocked by the template in accordance with an embodiment of the present disclosure.

FIG. 7 depicts the article of clothing after throw-dyes have adhered to the dress but have been blocked by the template in accordance with an embodiment of the present disclosure. The depiction includes the dress 380, the logo template 390 and thrown-dye 400 affixed to the dress 400 in random locations according to the present disclosure. In addition to or in place of a human thrower, an automated and remotely controlled mechanized thrower or dispersal device may be configured to throw one or more colored dyes into the path of one or more runners. A thrower may also include a device operated by a person, the device amplifying or assisting the thrower in pitching, hurling and otherwise getting the dye into the path of the runner. Such a device may therefore include a water pistol, a water cannon and the like and a fan configured to blow powdered dyes into the path of a runner.

Also, a throwing action of the thrower may be triggered by a sensor, including light, heat and sound sensitive devices configured to sense a runner's adjacency to the throwing station. Embodiments of the disclosure may include the throwing action of the thrower terminated via one of a predetermined period of time and a remote control of a predetermined period of time or a random period of time. Furthermore, a runner may be a human being, an animal and a mechanized device configured to wear and otherwise carry the clothing and/or articles.

Figure 8:
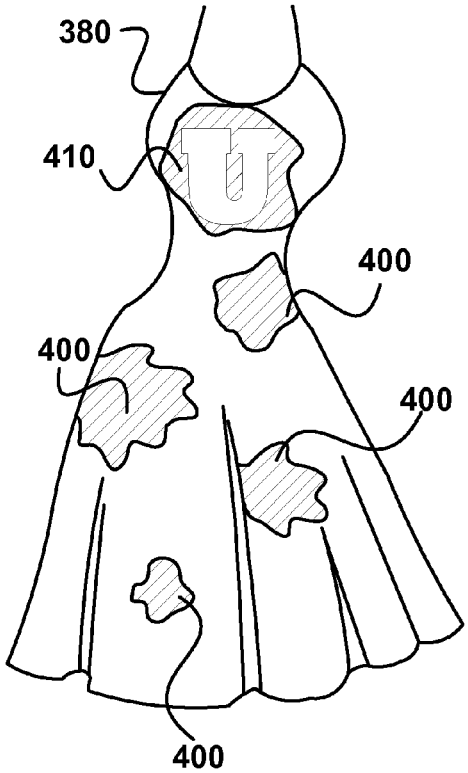
FIG. 8 depicts the dress after the logo template has been removed and the dyes have been fixed into the dress in accordance with an embodiment of the present disclosure.

FIG. 8 depicts the dress after the logo template has been removed and the dyes have been fixed into the dress in accordance with an embodiment of the present disclosure. The depiction includes the dress 380 and the fixed thrown-dye 400 and 410. The logo template 390 not depicted has been removed from its place on the dress to expose the outline of the logo onto the thrown-dye 410. Various dye colors may be used and combined to achieve compound colors on the dress 380.

Embodiments of the disclosure may include a succession of throwing stations in series, each of the successive throwing stations provided and labeled with a single colored dye, the dye thrown on the runner's article(s) of clothing at the station indicating the runner has reached the respective station. Also, a to plurality of throwing stations may be placed in parallel, each of the throwing stations provided and labeled with a single colored dye, the dye thrown from the station onto the runner's article(s) of clothing indicating a runner's choice for color on his/her article(s) of clothing. In other words, the runner may choose the colors thrown or tossed onto his or her clothing simply by choosing which throwing station to pass by in his or her running route. The runner may do this intentionally or randomly. Throwing stations may be marked with the color that is thrown therefrom and therefore give a runner a conscious choice of which color gets thrown or tossed onto their clothing and accessories.

Clothing designed via the disclosure may remind the wearer of the running event or sports event they experienced while wearing the clothing article. Also, the particular pattern of color on the article of clothing may indicate how far the wearer ran or what route the runner took to complete the event. Such 'custom designed' clothing gets attention and projects something unique about the wearer to others. In other words, clothing designed via the present disclosure tells a story of an experience and conveys a unique image of the wearer. For these reasons and more, the methods and systems and embodiments of the disclosure satisfy a long felt need for consumers to be able to buy custom clothing that projects a particular image to others and/or reminds the wearer of a particular place or event.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A system of design for an article of clothing, comprising:

a) at least one article of substantially white clothing worn on at least one runner of a multi-runner event;

b) a plurality of colored powder dyes provided at a plurality of tossing stations placed along at least one route of the event;

c) at least one tosser positioned at a tossing station for tossing at least one of the dyes onto the runner's white clothing as the runner passes by the tossing station wherein a tosser dispersal mechanism is actuated by a sensor configured to sense a runner's adjacency to the tossing station; and d) a random pattern of toss-dye on the runner's white clothing based on a confluence of the tossed colored dye(s) and the white clothing on the runner on a path through the tossed dye(s).

2. The system of design for an article of clothing of claim 1, further comprising a toss-dye configured to stick to the article(s) of clothing in places where moisture is present on the article(s), the moisture provided via one of sweat from the runner and water and other fluids coming from sources external to the runner.

3. The system of design for an article of clothing of claim 1, further comprising a logo template configured to apply to the runner's clothing and block the toss-dyes from making contact with the runner's clothing and therefore outlining the logo on the runner's clothing with the toss-dyes.

4. The system of design for an article of clothing of claim 1, further comprising a fixing chemical including one of vinegar and a catalyst including heat applied to the runner's clothing, the fixing chemical and catalyst configured to fix the toss-dye(s) into the runner's clothing.

5. A system of design for an article of clothing, comprising:

a) at least one article of clothing worn on at least one runner of an event;

b) a plurality of colored dyes provided at a plurality of throwing stations;

c) at least one thrower positioned at a throwing station for throwing at least one of the dyes onto the article(s) of clothing as the runner passes by the throwing station wherein a thrower dispersal mechanism is actuated by a sensor configured to sense a runner's adjacency to the throwing station; and d) a random pattern of throw-dye on the article(s) of clothing based on a confluence of the thrown colored dyes and the article(s) of clothing on the runner on a path through the thrown dye(s).

6. The system of design for an article of clothing of claim 5, wherein the thrower comprises one of an automated and remotely controlled mechanized dispersal device configured to throw a colored dye into the path of a runner.

7. The system of design for an article of clothing of claim 6, wherein the thrower dispersal mechanism is terminated via one of a predetermined period of time and a remote control.

8. The system of design for an article of clothing of claim 5, wherein a runner is a human being, an animal and a mechanized device.

9. The system of design for an article of clothing of claim 5, further comprising a succession of throwing stations in series, each of the successive throwing stations provided and labeled with a single colored dye, the dye thrown on the runner's article(s) of clothing at the station indicating the runner has reached the respective station.

10. The system of design for an article of clothing of claim 5, further comprising a plurality of throwing stations in parallel with the path of the runner, each of the throwing stations provided and labeled with a single colored dye, the dye thrown from the station onto the runner's article(s) of clothing indicating a runner's choice for color on his/her article(s) of clothing.

11. The system of design for an article of clothing of claim 5, wherein the article of dress comprises any clothing and clothing ensemble worn on the client's body and any clothing and clothing ensemble worn over clothing on the client's body and any fashion accessory including foot apparel and leg apparel, gloves, a belt, a scarf, a hat, a wig, a bow and neck tie, suspenders, hosiery and the like.

12. The system of design for an article of clothing of claim 5, wherein the event comprises at least one of a race, a sporting event, a corporate event, a scholastic event, a fashion party, and a production plant shift.

* * * * *